US005129734A

United States Patent [19]

Van Erden

[11] Patent Number: 5,129,734

[45] Date of Patent: Jul. 14, 1992

[54] SEAL SYSTEM FOR BLOCK CHEESE

[75] Inventor: Donald L. Van Erden, Wildwood, Ill.

[73] Assignee: Illinois Tool Works Inc., Glenview, Ill.

[21] Appl. No.: 683,693

[22] Filed: Apr. 11, 1991

[51] Int. Cl.[5] ..... B65D 33/16

[52] U.S. Cl. ..... 383/61; 383/9; 383/63

[58] Field of Search ..... 383/61, 63, 9

[56] References Cited

U.S. PATENT DOCUMENTS

| | | | |
|---|---|---|---|
| 3,110,335 | 11/1963 | Antonius | 383/63 X |
| 3,280,870 | 10/1966 | Bundy | 383/63 X |
| 4,262,581 | 4/1981 | Ferrell | 383/63 X |
| 4,589,145 | 5/1986 | Van Erden et al. | 383/63 X |
| 4,615,045 | 9/1986 | Siegel | 383/9 X |
| 4,709,400 | 11/1987 | Bruno | 383/63 X |
| 4,756,629 | 7/1988 | Tilman et al. | 383/63 |
| 4,832,505 | 5/1989 | Ausnit et al. | 383/63 X |
| 5,026,563 | 6/1991 | Van Erden et al. | 383/61 X |

*Primary Examiner*—Stephen Marcus
*Assistant Examiner*—Jes F. Poscua
*Attorney, Agent, or Firm*—Hill, Van Santen, Steadman & Simpson

[57] ABSTRACT

A method and apparatus for forming a package for a three dimensional block wherein the package is formed of flexible film doubled along one edge with end seals joining the ends of the film and a reclosable zipper along the other remaining edge with the zipper being longer than the length of the block and longer than the space between the end seals so that as the zipper is opened, a mouth is formed sufficiently large to allow for insertion or removal of the block through the mouth of the package.

8 Claims, 1 Drawing Sheet

FIG. 1
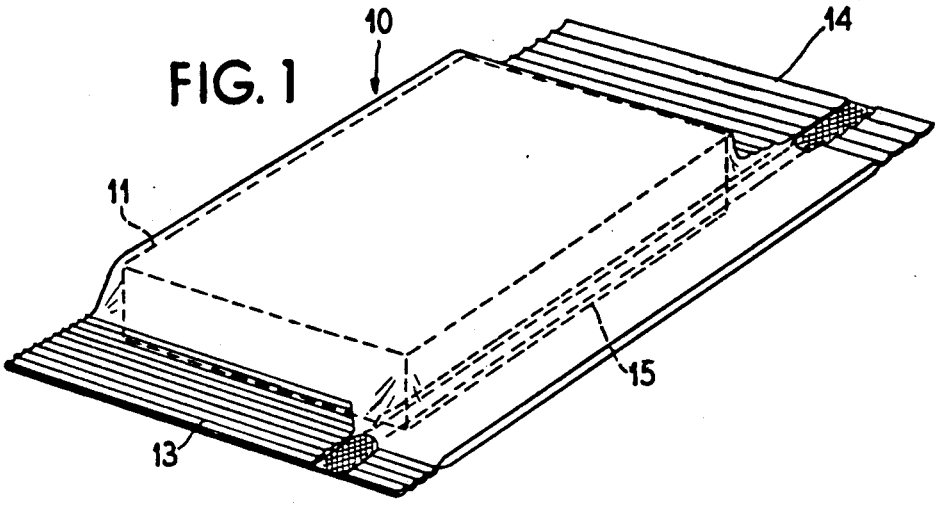
FIG. 2
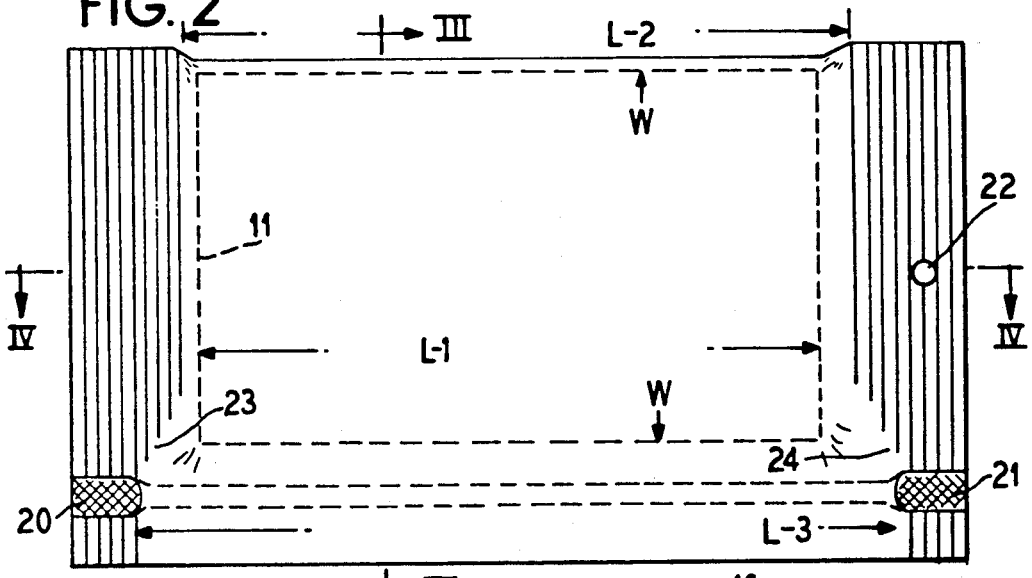
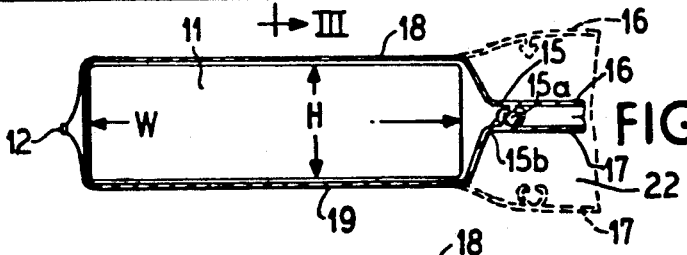
FIG. 3
FIG. 4
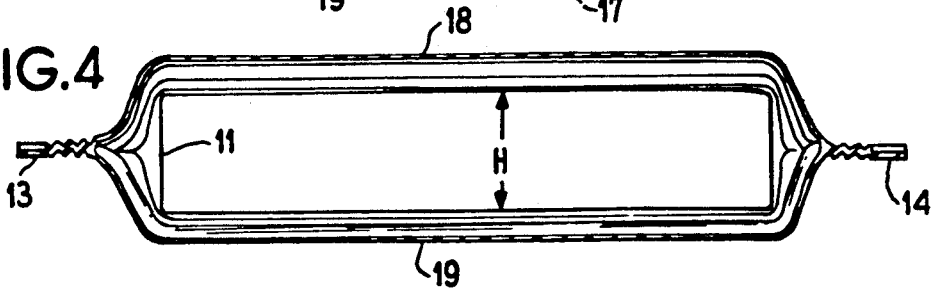

SEAL SYSTEM FOR BLOCK CHEESE

BACKGROUND OF THE INVENTION

The invention relates to improvements in packaging, and more particularly to a flexible film package for use for block form contents such as a block of cheese.

More particularly, the invention pertains to a reopenable package which is particularly well suited for a foodstuff material such as meat or a block of cheese wherein the block can be removed from the package and reinserted with the package sealed by a zipper between usage to protect the contents from contamination and exposure to air. One form of such package adapted to contain a food product is disclosed in my U.S. Pat. No. 4,589,145 and certain features of the package are utilized in the embodiment of the present invention.

Block cheese and other food products with thick areas having a length, width and height cannot be packaged in zipper film packages without providing extra room in the package so that the block can be removed through the zipper opening. When extra room is provided in a package of ordinary construction, the additional film material necessary to afford space for the block to be removed and reinserted makes the package appear to be under filled. This, of course, is undesirable inasmuch as it creates a negative reaction from the customer.

Further, with a conventional bag or package if the package must be made sufficiently large so that the block of foodstuffs can be removed and reinserted, the extra size uses an unnecessary amount of film which contributes to additional costs. The extra film that is provided makes the package appear baggy and unsightly, and when stacked or handled, the extra film material tends to pucker and wrinkle and the overall package is not as attractive as would be desirable.

FEATURES OF THE INVENTIONS

It is an object of the present invention to provide an improved flexible film package with a reopenable zipper wherein the aforesaid disadvantages are avoided and an attractive package is achieved which utilizes a minimum amount of film.

A further object of the invention is to provide a reopenable package such as for a block of cheese which is provided with a reclosable zipper and affords the unique advantage of having a large opening mouth for removal and reinsertion of the cheese block.

A further object of the invention is to provide an improved zipper reclosable package for block form contents constructed to have a large opening mouth with the body of the package fitting relatively snugly to the block form contents.

In accordance with the features of the invention, package construction is achieved which is particularly well suited for block form foodstuff such as a block of cheese and where the package can be formed by wrapping over the cheese during packaging at the location of the manufacturer. Also, the package can be preformed and the block of cheese inserted into the package at a later time. Whatever the form of use, the resultant package has an enlarged opening mouth so that the consumer can readily open the zipper opening of the package to remove the block of cheese and reinsert it and close the zipper and yet the package fits relatively closely around the block form shape so that almost a custom package fit is achieved.

Other features, objects and advantages will become more apparent with the teaching of the principles of the invention in connection with the disclosure of the preferred embodiments thereof in the specification, claims and drawings, in which:

DESCRIPTION OF THE DRAWINGS

FIG. 1 is perspective view of a package constructed and formed in accordance with the principles of the present invention;

FIG. 2 is a plan view of the package of FIG. 1;

FIG. 3 is a vertical sectional view taken substantially along line III—III of FIG. 2; and FIG. 4 is a vertical sectional view taken substantially line IV—IV of FIG. 2.

DESCRIPTION OF THE PREFERRED EMBODIMENTS

FIG. 1 illustrates a completed package 10 for containing contents in block form such as a block 11 of cheese. The package is formed of a flexible film having an upper layer 18 and a lower layer 19, FIG. 3. The layers may be formed over the block at the time of packaging which is a preferred arrangement, or may be preformed with the block inserted later.

The block is three dimensional having a length shown as L-1 in FIG. 2, a width shown as W in FIGS. 2 and 3 and a height H shown in FIGS. 3 and 4. Because of the height H, if a typical envelope form package were used, the package would have to be made sufficiently large so that the block would be inserted into the opening or mouth of the envelope. The body of the envelope would then be as big as the mouth so that the envelope would appear oversized and gaps would appear around the contents making the envelope appear to be only partially filled. With the present package, a snug form fitting custom appearing package is achieved and yet the opening mouth is sufficient so that the contents can be readily withdrawn and reinserted.

The flexible film package is wrapped over the block 11 with a back edge at 12 which may have a seam or which may be continuous so that the film is merely doubled to form an upper layer 18 and a lower layer 19 with the block therebetween.

At the ends of the package, seams 13 and 14 are formed to draw the film relatively tightly over the block 11. These seams 13 and 14 extend the width of the film. The seams are separated from each other a distance L-2 as shown in FIG. 2 which is slightly greater than the length L-1 of the block. The seams can be readily formed by heat sealing, that is, applying a heated shoe on opposing sides of the film. The film usually is a thermoplastic material such as polyethylene so that the layers will be rapidly and readily joined with the application of a medium amount of heat.

Along one edge of the package between the upper and lower layers is a pressure reclosable rib and groove element zipper 15, and it will be recognized by those versed in the art, that the zipper has a rib **15*a* which will lock into a groove 15*b* to close the package and protect the contents from contamination and exposure to air. Outwardly from the zipper elements are pull flanges 16 and 17 which can be pulled apart to open the package as shown by the dotted line positions of the flaps 16 and 17 in FIG. 3. In some instances it may be desirable to seal or join the outer distal edge of the flaps 16 and 17** to provide a tamper-evident seal. The joined edges are cut off when the package is to be first used and the flanges to be pulled apart.

A unique feature of the zipper is that its length L-3, as shown in FIGS. 2, is longer than the distance L-2 between the end seams. With this structure when the zipper is pulled apart, the flexible material of the film provides a bag mouth 22, FIG. 3, sufficient so that the block of cheese easily slides out. Also, the block can easily be reinserted. The block will fit relatively snugly between the seams 13 and 14.

To allow for a longer zipper, the side seams taper or narrow in the area of the zipper as shown at 23 and 24 in FIG. 2. The side seams extend past the end of the zipper but allow it to be longer than the length L-1 of the product and longer than the length of the package L-2 between the seams.

At the ends of the zippers are spot seals 20 and 21 joining the layers of film.

In a preferred arrangement, the end seams 13 and 14 are narrowed at their ends such as 23 and 24 on both ends of the package. However, in another form of construction, the end seam can be narrowed only at one end and run full width at the other end. In that structure, the zipper will extend longer only at the end where the end seam is narrowed. The requirement is that the zipper be sufficiently long so that there is adequate material in the layers of film to separate to form a wide package mouth.

Thus, the package can have a neat tailored appearance such as illustrated in FIG. 1 with the end seams joining the layers right up to adjacent the block 11. The zipper 15 can be up fairly tight to the block so that the resultant package will give the appearance to the purchaser that is completely filled with the product. Yet, the purchaser will have the benefit of a reopenable package so that the contents can be partly used and again reinserted to be protected within the zipper closable package. If the contents is a block of cheese, the user may choose to slice portions off of the long side, as indicated by the dimension L-1, and the mouth of the package will open sufficiently to insert the full dimension of the cheese block into the package mouth.

The end seams are shown as being flat and of substantial width but narrower seams may be used. The arrangement permits using rectangular film material to provide an attractive square shaped package. The broad end seams also permit the provision of a hanging opening 22, FIG. 2, for supporting the package on a hook for store display.

Thus, it will be seen that I have provided a flexible film package for block form foodstuffs which meets the objectives and advantages above set forth and provides for a reclosable package which is promotionally attractive in a store and which is functionally attractive as far as the purchaser is concerned.

I claim as my invention:

1. A package with contents in the form of a three dimensional block having a width, length and height comprising in combination:

a flexible film wrap for forming a reclosable package for a block with the film having upper and lower layers;

ends seals joining the layers at opposite ends of the length of the unit, said end seals extending across the width of the package at the ends and spaced apart a first length slightly longer than the length of the block;

a pressure reclosable rib and groove zipper extending along one side of the length of the package with said zipper extending longer than said first length so that when the zipper is separated to form a package mouth the layers of the film separate sufficiently to accommodate the height of the block as the block is removed or reinserted into the package through the mouth;

and spot seals at the ends of the zipper;

the end seal at one end of the package being narrower at the location of the spot seal than at the location of the block.

2. A package for a three dimensional block having a width, length and height having the structure of claim 1:

including spot seals at the ends of the zipper joining the end seals.

3. A package for a three dimensional block having a width, length and height having the structure of claim 1:

wherein the end seals extend across the full width of the film and across the ends of he zipper wherein the end seals each become narrow in the location of the zipper to accommodate the length of the zipper.

4. A package for a three dimensional block having a width, length and height having the structure of claim 1:

wherein the end seals extend fully to the edge of the film.

5. A package for a three dimensional block having a width, length and height having the structure of claim 1:

wherein the film is continuous and wrapped around the edge of the package at the edge opposite the zipper.

6. A package for a three dimensional block having a width, length and height having the structure of claim 1:

including means defining a hanging opening at one end of the package in the end seal;

the end seal at said one end of the package being of sufficient width to accommodate said opening.

7. A package for a three dimensional block having a width, length and height having the structure of claim 1:

wherein said end seals are parallel to each other.

8. In combination, a three dimensional substantially rectangular block having a width, height and length:

a flexible film package material covering the block having upper and lower layers with the upper and lower layers seamed to each other at the ends of the block by end seams and the seams being immediately adjacent the block so as to form a snug package around the block ends;

said end seams being parallel to each other;

means defining a hanging hole in one of said end seams;

the layers being joined to each other along one length of the block;

and a reclosable zipper extending along the other length of the block in close adjacency to the block and being of a length longer than the block so as to be separable to provide a wide mouth for the package layers for removal and reinsertion of the block.

* * * * *